United States Patent [19]

Charbonnet

[11] 4,062,535

[45] Dec. 13, 1977

[54] APPARATUS FOR HANDLING SHEETS OF MATERIAL

[76] Inventor: Carl D. Charbonnet, 700 Braddock Ave., Birmingham, Ala. 35213

[21] Appl. No.: 733,382

[22] Filed: Oct. 18, 1976

[51] Int. Cl.[2] ..... B65H 29/54

[52] U.S. Cl. ..... 271/174; 271/197

[58] Field of Search ..... 271/DIG. 2, 174, 197, 271/218

[56] References Cited

U.S. PATENT DOCUMENTS

| | | | |
|---|---|---|---|
| 3,228,273 | 1/1966 | Huffman | 271/197 X |
| 3,285,607 | 11/1966 | Lindemann | 271/218 |
| 3,419,265 | 12/1968 | Greco et al. | 271/197 |
| 3,452,982 | 7/1969 | Bischoff | 271/197 |
| 3,918,586 | 11/1975 | Tyler et al. | 271/197 X |

*Primary Examiner*—Robert W. Saifer

*Attorney, Agent, or Firm*—Jennings, Carter & Thompson

[57] ABSTRACT

Apparatus for handling sheets of material in which the sheets are received at a pick-up station and conveyed to a discharge station by means of a carrier, in combination with means to maintain a differential of pressure between the sheets and a plenum chamber beneath which a flight of the carrier operates. The invention also contemplates means to discharge the sheets at the discharge station comprising a stripper which enters between the sheet of material being conveyed and the plenum, thus to admit air under atmospheric pressure between the two, permitting the sheet to drop off. The invention contemplates also the use of means to release the vacuum on the sheet of material being conveyed by momentarily shutting off the suction fan from the plenum chamber, permitting the sheet to drop.

2 Claims, 6 Drawing Figures

Fig 2
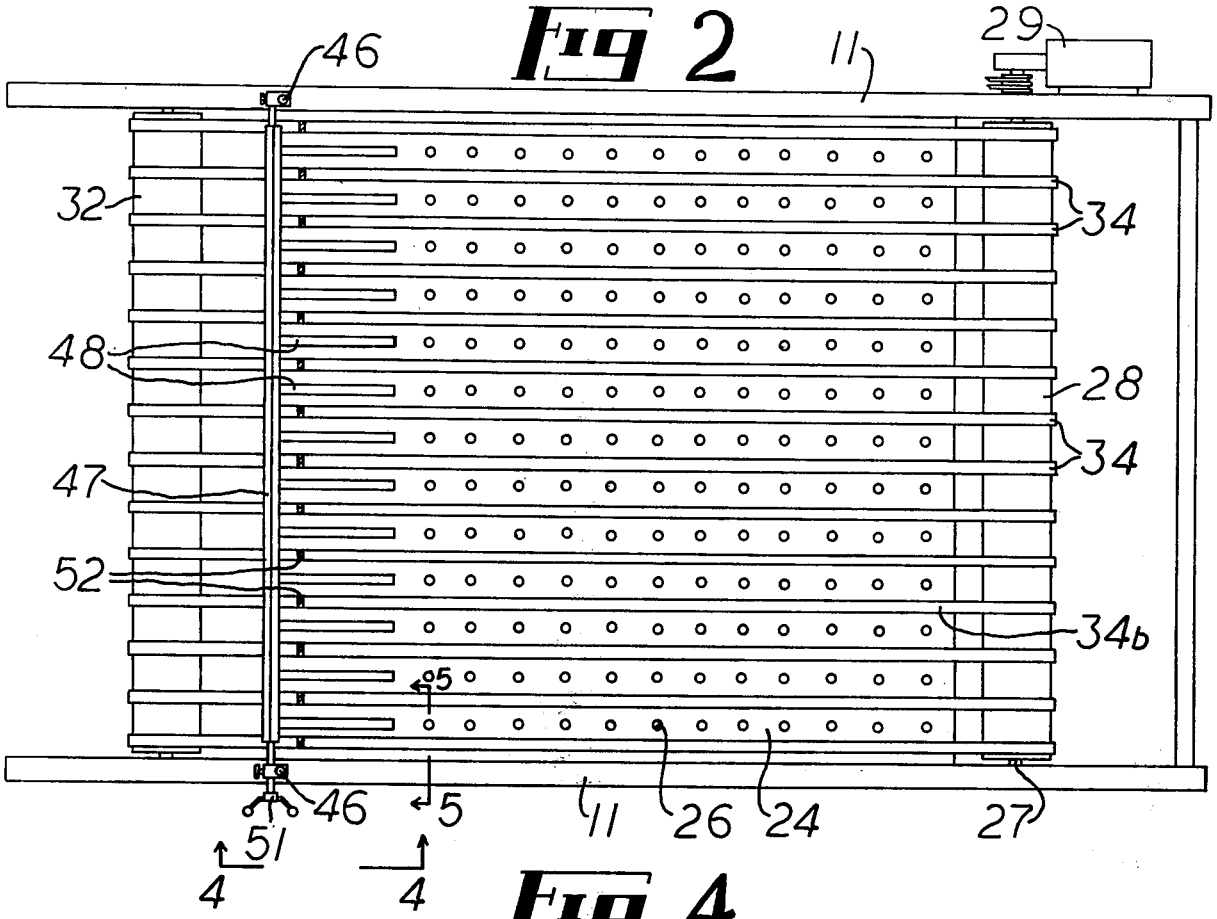
Fig 4
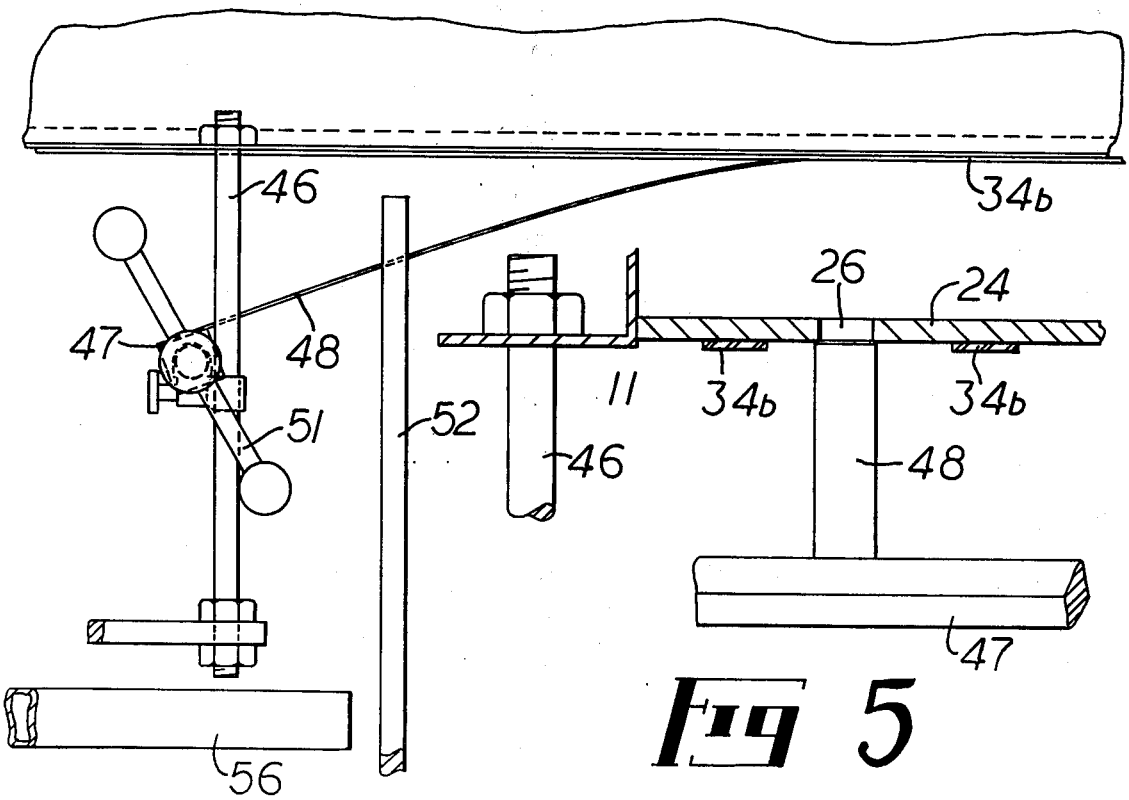
Fig 5

APPARATUS FOR HANDLING SHEETS OF MATERIAL

This invention relates to apparatus for handling sheets of material, namely, for receiving sheets of material at one station, transferring them one-by-one to another station, and depositing them in a pile, correctly oriented one to another at the discharge station.

My invention may be employed to stack materials, or if desired, to have presented to the same a stack of material and to remove the sheets therefrom, one-by-one and send them on to subsequent manufacturing processes.

More specifically my invention contemplates the provision of apparatus of the character designated in which there is a plenum chamber and an endless, belt-like carrier having upper and lower flights. The lower flight of the carrier runs closely adjacent the bottom wall of the plenum chamber, and this bottom wall is provided with a plurality of openings to atmosphere. The plenum chamber is maintained under sub-atmospheric pressure. Sheets of material are presented to the carrier at a sheet pick-up station. The sheets are transferred by the carrier while the negative pressure exists in the plenum chamber. At the discharge station the sheets may be discharged either by one or more mechanical strippers or, by shutting off the suction on the plenum chamber, or a combination of mechanical strippers and shutting off the negative pressure. In any event, the sheets are dropped at the discharge station, neatly piled, ready for subsequent processing, shipping, or the like.

Apparatus illustrating features of my invention is shown in the accompanying drawings, forming a part of this application, in which:

FIG. 2 is a detail sectional view taken generally along line 2—2 of FIG. 1;

FIG. 4 is a fragmental detail elevational view taken generally along line 4—4 of FIG. 2;

FIG. 5 is an enlarged detail fragmental view taken generally along line 5—5 of FIG. 2; and, FIG. 6 is a detail sectional view taken on line 6—6 of FIG. 1.

Figures 1, 9:
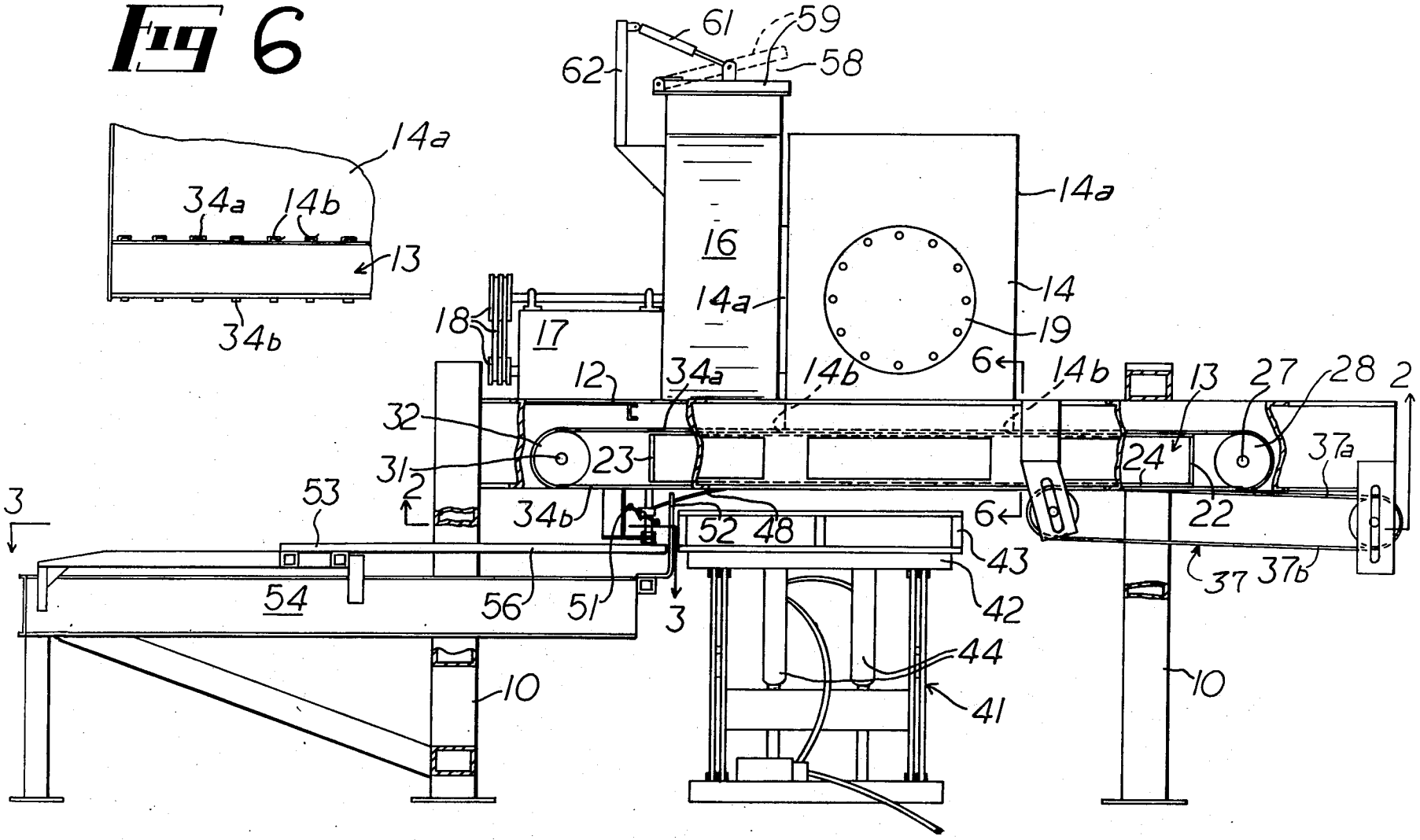
FIG. 1 is a diagrammatic side elevational view, certain of the parts being broken away and in section.

Referring now to the drawings for a better understanding of my invention I show in FIG. 1 in somewhat diagrammatic form a side elevational view of the same, with certain parts broken away. Thus, the apparatus may be supported on vertical members 10 to which are connected longitudinally extending members 11. See particularly FIG. 2. Various cross members such as 12 may be provided thus to provide an open framework for supporting the working parts of the mechanism.

Mounted in suitable fashion on the framework is a lower plenum chamber indicated at 13. An upper plenum chamber 14 rests on top of the lower plenum and is provided with a plurality of cutouts in its end walls, thus to pass the upper flight of a belt-like carrier as will be explained. Chamber 14 is connected to a suction fan 16, the fan being driven by a motor 17 through belts and pulleys indicated at 18. The chamber 14 may have a removable manhole cover 19 for the purpose of gaining access to the inside thereof.

The plenum chamber 13 extends from a rear end wall 22 forwardly to a front wall 23. Further, the plenum may have a bottom 24 which is provided with a multiplicity of openings 26 communicating with atmosphere.

Mounted on a cross shaft 27, extending transversely between the frame members 11 and supported for rotation therein, is a roller 28. The shaft 27 and hence the roller 28 may be driven by a motor 29 as indicated in FIG. 2.

Forwardly of the wall 23 is another shaft 31 which carries a roller 32. Trained over the rollers 28 and 32 is a plurality of relatively narrow belts 34, the upper flights **34*a* of which pass over the upper wall 36 of the plenum 13 and the lower flights 34*b* of which pass closely beneath the lower, perforated wall 24 of the plenum 13. Also the upper flights 34*a* pass through the cutouts 15** in the end walls of the upper plenum.

A conveyor belt 37 is mounted at a slight infeed angle to the belts 34, adjacent roller 24, so that sheets of material fed on top of the flight **37*a* of belt 37 are delivered to the lower flights 34*b* of the belts 34 as will presently be explained. The belt 37** thus constitutes a material pick-up or receiving station.

A material discharge station is indicated generally by the numeral 41 and comprises a table 42 which may support a pallet or the like 43 to receive the sheets of material. The table is mounted for raising or lowering or hydraulic or air cylinders 44 so that as the stack builds up on top of the pallet the pallet may be lowered.

Mounted for vertical adjustment on shafts 46 is a cross bar 47. The cross bar carries a plurality of thin spring steel stripper members 48, narrow enough to enter between the lower flights **34*b* of the belts 34 as shown particularly in FIGS. 4 and 5. The bar 47 carrying the several scraper or stripper members 48 may be angularly and vertically adjustable, thus to place more or less pressure on the fingers 48 in an upward direction. As shown in FIG. 4, the strippers are concave as viewed from beneath. The extent of this concavity may be controlled by adjusting the angular position of cross bar 47. The bar is held in selected angular position by means of a locking nut 51**.

Mounted adjacent the side of the pallet 43 is a plurality of vertically extending, spaced stop members 52. As will later appear, as the material is stripped or wiped from the lower flights of the belts, the edge of the sheet hit the members 52, thus to align them, prior to dropping them onto the top of the pallet 43.

Figure 3:
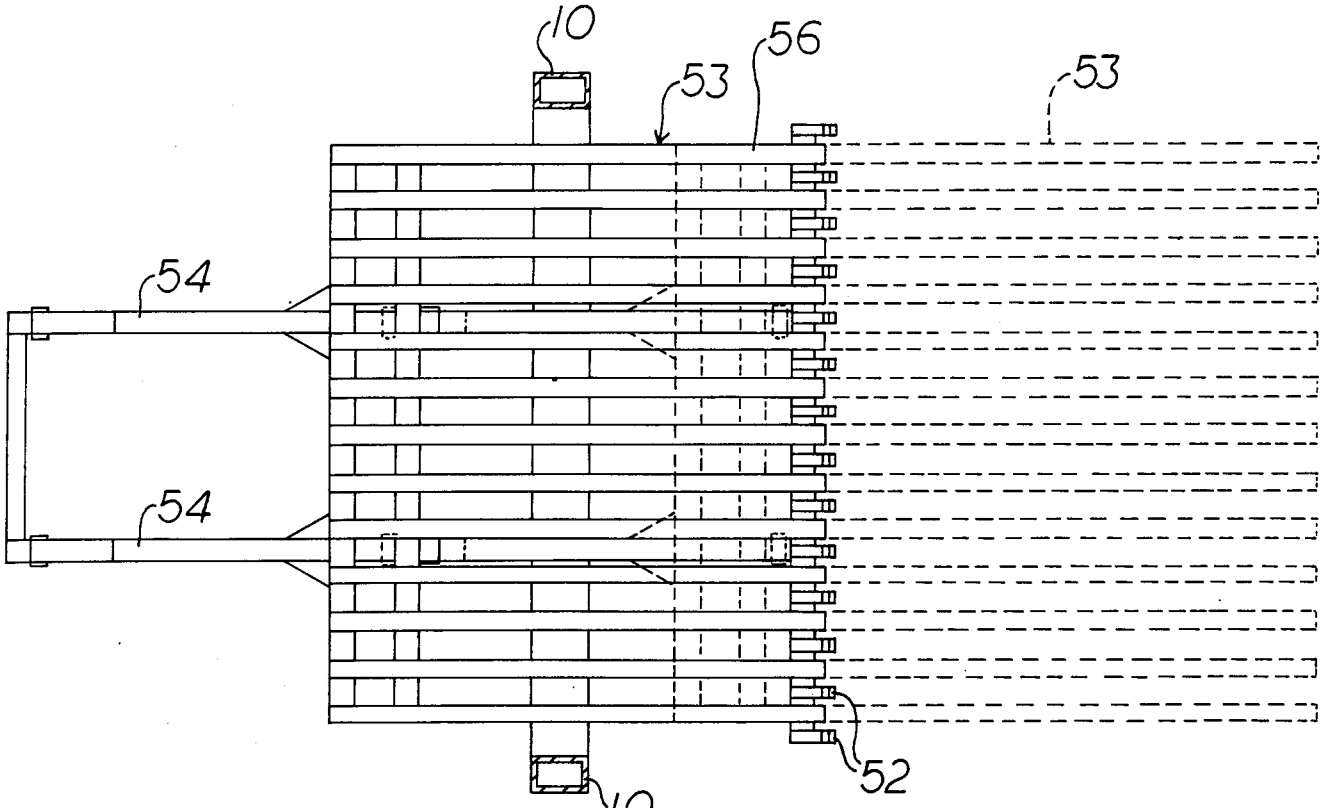
FIG. 3 is a detail sectional view taken generally along line 3—3 of FIG. 1.

It will be understood that the object of this apparatus is to receive a plurality of sheets, continuously, stack them onto the pallet 43, and to be able to remove the pallet 43 without interrupting the operation of the apparatus. To this end I provide a shuttle receiver or rack member indicated generally by the numeral 53. As shown in FIGS. 1 and 3, this unit is mounted for reciprocation on spaced support members 54.

The member 53 comprises a plurality of relatively narrow tines 56 adapted to reciprocate from the full line positions indicated in FIGS. 1 and 3 to the dotted line positions indicated in FIG. 3. These tines are so arranged that they will enter between the members 52. Means, not shown, is provided for reciprocating the unit 53 and this may be in the form of an air cylinder or the like. Suffice it to say, however, that the tines 56 reciprocate to the right as viewed in FIG. 3, to occupy a sheet material receiving position during the times when a filled pallet 43 is being removed, thus permitting the machine to operate continuously.

Referring again to FIG. 1 I show the fan 16 as being provided with an opening 58 to atmosphere and which is adapted to be closed by a plate valve 59. The valve 59 may be under control of an air cylinder 61 mounted on a bracket 62. The plate 59 normally is held raised by the discharge air to the dotted line position shown in FIG. 1. When in the full line position the flow of air through the opening 26 substantially ceases, permitting the sheet to drop as will be explained. If desired the valve 59 may be counterweighted to regulate the degree of negative pressure, permitting the apparatus to handle sheets of varying weights, flexibility and the like.

With the foregoing description of the mechanism in mind, its function, operation and advantages may now be more fully explained and understood.

With the fan 16 in operation the plenum chamber 13 is maintained under a suitable degree of negative pressure. Sheets of material are fed to the apparatus by bringing the ends thereof into position to lie on top of the upper flight 37*a* of belt 37. As seen in FIG. 2, therefore, the sheets to be stacked move from right to left, coming under the lower plenum chamber. The negative pressure tends to force the sheets into contact with the lower, perforated wall 24 of the plenun chamber 13. However, the relatively thin belts with the lower flights 34*b* thereof interposed between the sheets being conveyed and the bottom wall 24 cause the sheets to move laterally, with the free ends thereof suspended and held in raised position over the pallet 43. As the sheets progress, they come into contact with the plurality of wiper members 48 and atmospheric pressure is admitted between the tops of the sheets being conveyed and the bottom, perforated wall 24 of the plenum 13. The momentum of the sheets causes their edges to strike the plurality of vertical bar-like members 52, whereby they drop by gravity in alignment on top of the pallet 43. The pallet 43, due to the support mechanism 41, is gradually lowered as the stack builds up. When a full stack has been accumulated the stack is lowered sufficiently to permit the shuttle member 53 to move with its tines into position to receive the sheets as they are delivered, namely, to the dotted line position of FIG. 3. The filled pallet is now removed, an empty one inserted in its place, and the raising mechanism is actuated to bring the pallet up substantially beneath the tines 56. The tines 56 are now retracted back to the full line position shown in FIGS. 1 and 3, whereby the sheets which have been accumulated engage the bars 52, depositing the entire temporarily accumulated group of sheets onto the top of the new pallet.

If it is desired to do so the sheets may be caused to drop onto the pallet or the tines, as the case may be, by actuating the cylinder 61. This reduces the pressure inside the plenums substantially to atmospheric, whereby the sheets then being conveyed fall by gravity onto the pallet or the tines, as the case may be.

Referring to FIG. 6, it will be seen that the end walls 14*a* of the upper plenum 14 are notched out as at 14*b* to pass the flights 34*b*. While there is some leakage of air through these notches, it is not enough seriously to affect the overall operation of the apparatus.

In view of the foregoing it will be seen that I have devised an improved apparatus for accumulating sheets of material. It further will be seen that my improved apparatus may be used also to take sheets, one by one, from a stack of the same and deliver them, one by one, for subsequent processing. In other words, simply by reversing the direction of rotation of the lower flights 34*b* of the belts 34 and the conveyor 37, I could take sheets one by one from a stack of the same on a pallet 43 and deliver them to the right as viewed in FIGS. 1 and 2, from the belt 37.

My invention has proved to be practical and satisfactory in actual practice.

While I have shown my invention in but one form, it will be obvious to those skilled in the art that it is not so limited but is susceptible of various changes and modifications without departing from the spirit thereof.

What I claim is:

1. In apparatus for handling sheet-like material, a. a material pick-up station, b. a material discharge station, c. a plenum maintained under sub-atmospheric pressure and having openings to atmosphere in a lower wall thereof, d. an endless carrier member having upper and lower flights, said lower flight passing closely adjacent the lower wall of the plenum, e. means at said pick-up station to present sheets of said material to the lower surface of the lower flight of the carrier, whereby the sheets are held for movement with said lower flight, f. means to remove the sheets from said flight of the carrier at the discharge station comprising a stripper member adapted to enter between the sheet being conveyed and the lower wall of the plenum, thereby to reduce the holding effect due to the total differential pressure on the sheet to a value less than the weight of the sheet, and g. means supporting said stripper for vertical adjustment toward and from the bottom wall of the plenum, whereby to accommodate the apparatus to the handling of sheets of different weights and flexibility.

2. Apparatus as defined in claim 1 in which said stripper is concavely shaped on its sheet engaging side, and means to vary the concavity of the stripper, thereby to determine within a predetermined range where a given sheet leaves the carrier.

* * * * *